US006637738B1

(12) United States Patent
Beaudet

(10) Patent No.: US 6,637,738 B1
(45) Date of Patent: Oct. 28, 2003

(54) VISE MOUNTABLE TOOL HOLDER BRACKET

(76) Inventor: Donald Beaudet, 430 Tirrell Hill Rd., Goffstown, NH (US) 03045

( * ) Notice: Subject to any disclaimer, the term of this patent is extended or adjusted under 35 U.S.C. 154(b) by 0 days.

(21) Appl. No.: 10/198,458

(22) Filed: Jul. 18, 2002

(51) Int. Cl.[7] ..... B25B 5/16
(52) U.S. Cl. ..... 269/271; 269/277
(58) Field of Search ..... 269/271, 55, 74, 269/79, 71, 3, 6, 282, 270, 277, 95, 104, 123

(56) References Cited

U.S. PATENT DOCUMENTS

| | | | | |
|---|---|---|---|---|
| 2,696,389 A | | 12/1954 | Cessford | 280/293 |
| 4,846,353 A | | 7/1989 | Knight et al. | 211/22 |
| 5,171,003 A | * | 12/1992 | Kull | 269/95 |
| 5,320,227 A | | 6/1994 | Minoura | 211/22 |
| 5,497,967 A | | 3/1996 | Gantois | 248/166 |
| 5,564,681 A | * | 10/1996 | Glass | 269/271 |
| 5,873,568 A | * | 2/1999 | Mayfield | 269/41 |
| 6,253,496 B1 | * | 7/2001 | Gilchrist | 52/12 |

* cited by examiner

*Primary Examiner*—Lee D. Wilson
(74) *Attorney, Agent, or Firm*—Bourque & Associates, PA

(57) ABSTRACT

A vice holdable mounting bracket for a bicycle stand is described, the bracket being adapted so as to be able to be held in a vise when in use, and removed when not. The bracket holds the bicycle stand away from the work surface on which the vice is mounted, providing clearance to work easily on a bicycle held by the stand. Other tools besides bicycle stands may be mounted on the bracket. The bracket may have a removable rotatable and vertically adjustable mounting assembly, which may be positioned through use of a clevis or other similar fastener for easy adjustment and removal.

13 Claims, 7 Drawing Sheets

VISE MOUNTABLE TOOL HOLDER BRACKET

TECHNICAL FIELD

The present invention relates to tools, and more particularly relates to a vise mountable holder for a bicycle stand or other tool.

BACKGROUND INFORMATION

To perform certain service tasks on a bicycle, for example, removing wheels, it is common to support the bicycle in an inverted position, resting on a stand adapted to hold the bicycle.

Such stands are known in the art. Some are free standing for use on the floor but which often places the bicycle in an uncomfortably low position in which to work, or becomes increasingly unstable as the stand becomes taller.

Other stands are designed to be permanently mounted on a work bench. Inconveniently, these stands typically remain in place even when not in use, taking up valuable work bench space, especially for the home repairman. In a small workspace, this can pose a significant problem. Stands may be unbolted and removed, but it is a time consuming effort to do so.

Stands are frequently adapted to fit a particular model or brand of bicycle. Where there are many different brands and models of bicycles to be worked on, this variety of stands can take up considerable room on a workbench unless one goes to the not inconsequential effort and time to unbolt one stand and bolt an appropriate one in it place.

SUMMARY OF THE INVENTION

In one aspect, the present invention provides an article and method to hold a tool mounting bracket which may be held in a vise while in use, and removed when not in use. The tool mounting bracket has a support member having a vertical side to be held in the vise, and a second support member at an angle to the first support member, also having a vertical surface which may be aligned with the edge of the vise jaws when in use. There is a horizontal member attached to the two support member, extending outwardly from the surface on which the vise is mounted a distance, and on which is attached a plate which may be drilled receive a tool, such as a bench-mountable bicycle holder. The horizontal member is of sufficient length such that when in use with a bicycle holder, the bicycle clears the edge of the surface on which the vice is mounted.

The invention may be made from any suitable material, including wood or metal, such as steel or aluminum or combinations thereof. The support members may be made from angle stock, or from T stock or other shape suitable to be held in a vise and provide support for the horizontal member. The horizontal member may be made of channel, bar, T, I or solid stock.

In another aspect, the plate may have a vertical post on which a mating post may be place, the sleeve having a second horizontal plate thereon and on which a tool may be mounted. The posts may be made of hollow stock sized so that one post fits snugly over the other. In this aspect, the height of the plate maybe adjustable by having mating holes in the post and sleeve at different levels. In yet another aspect, the post and mating sleeve may be round, making the mounting plate rotatable, or may be of a regular polygonal shape, such as a triangle, square, hexagon or octagon to allow for a fixed set of angular rotations of the mounting plate.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

To overcome the limitations of the prior art, the present invention provides for a sturdy, stable but easily removable mounting bracket on which a bicycle clamp may be bolted, or in another embodiment, a variety of tools may be easily mounted and dismounted from the stand. The mount extends from the vise outwardly sufficiently to allow an object being held in a clamp mounted to the mounting bracket to be clear of the workbench or other surface to the vise is attached.

Figure 1A:
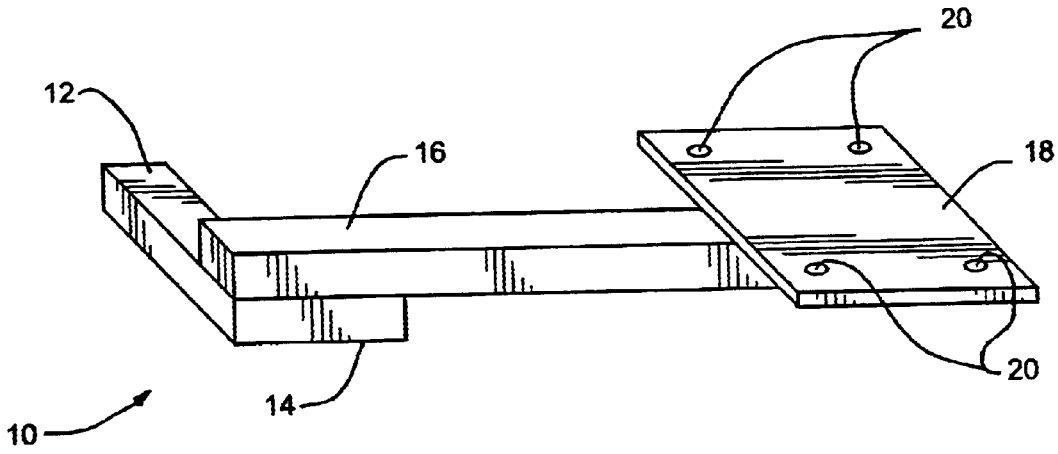
FIG. 1A is top oblique view of a mounting bracket according to the principles of the present invention.
Figure 1B:
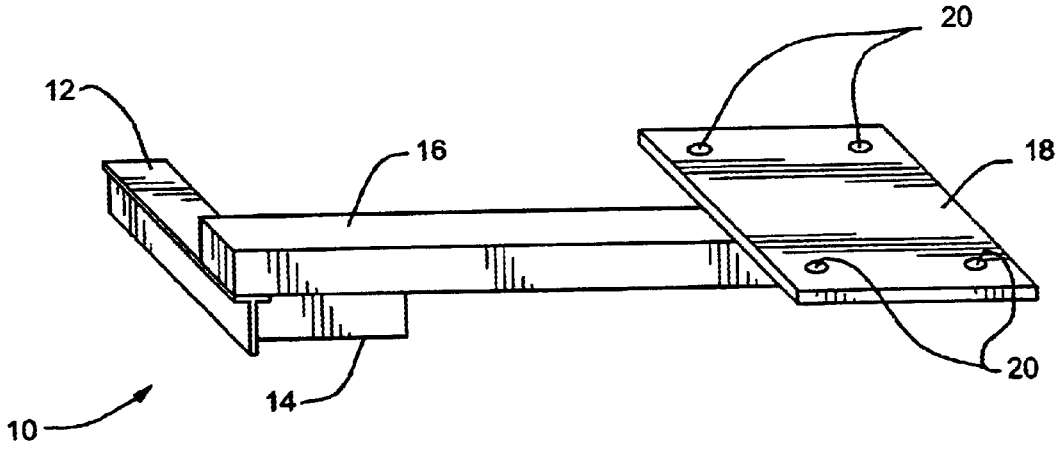
FIG. 1B is top oblique view of a mounting bracket according to another embodiment of the present invention.
Figure 2A:
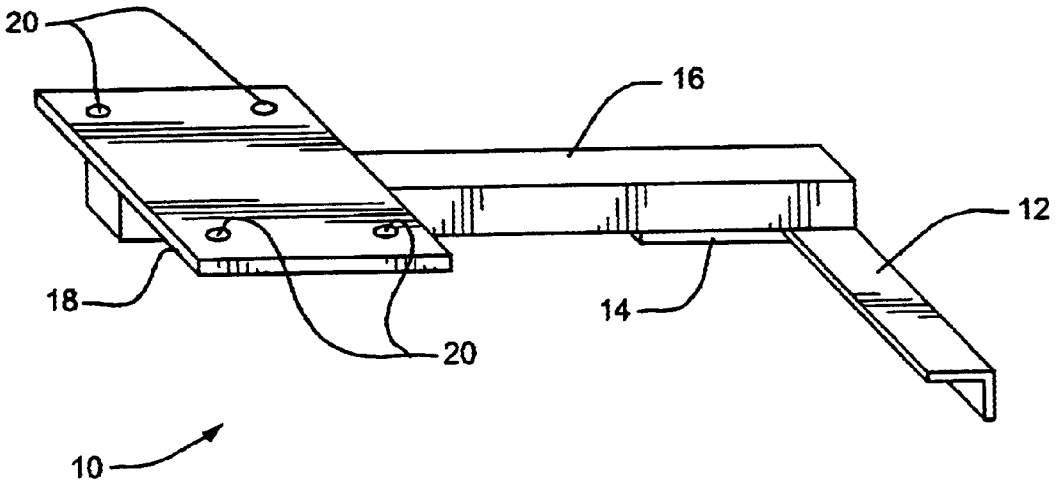
FIG. 2A is a top oblique view of the other side of a mounting bracket shown in FIG. 1A according to the principles of the present invention.
Figure 2B:
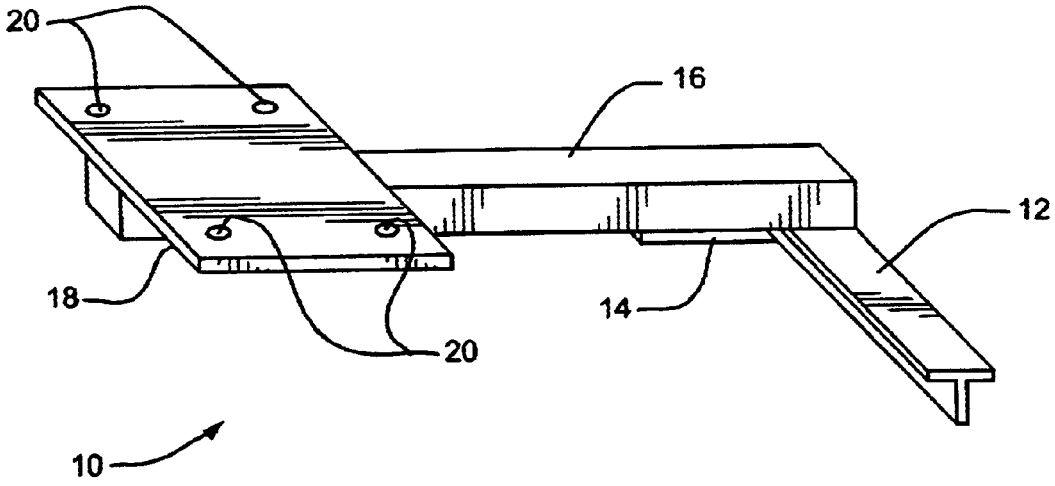
FIG. 2B is a top oblique view of the other side of a mounting bracket shown in FIG. 1B according to the principles of the present invention.
Figure 3A:
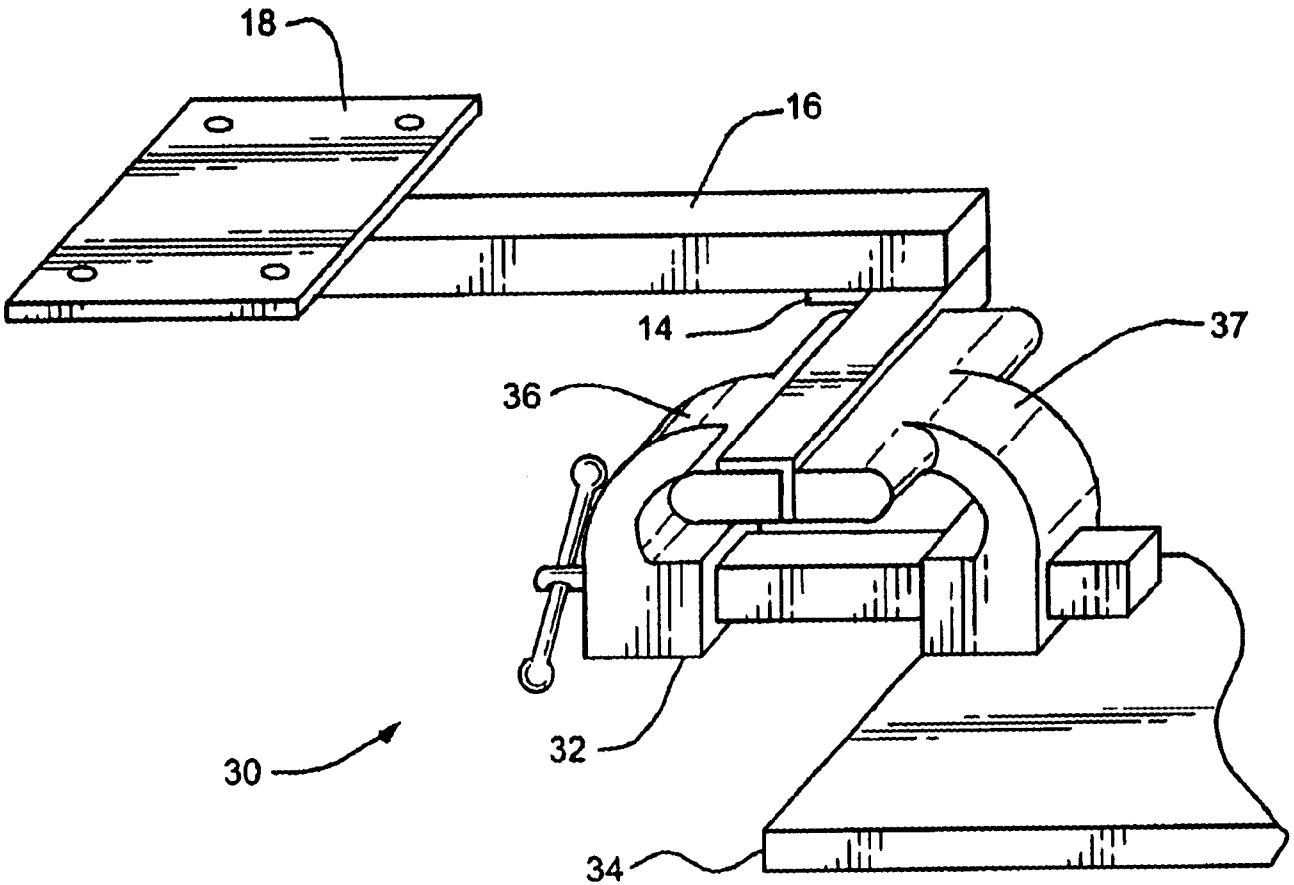
FIG. 3A is an oblique view of the mounting bracket shown in FIG. 2A in place in a vise, according to the principles of the present invention.
Figure 3B:
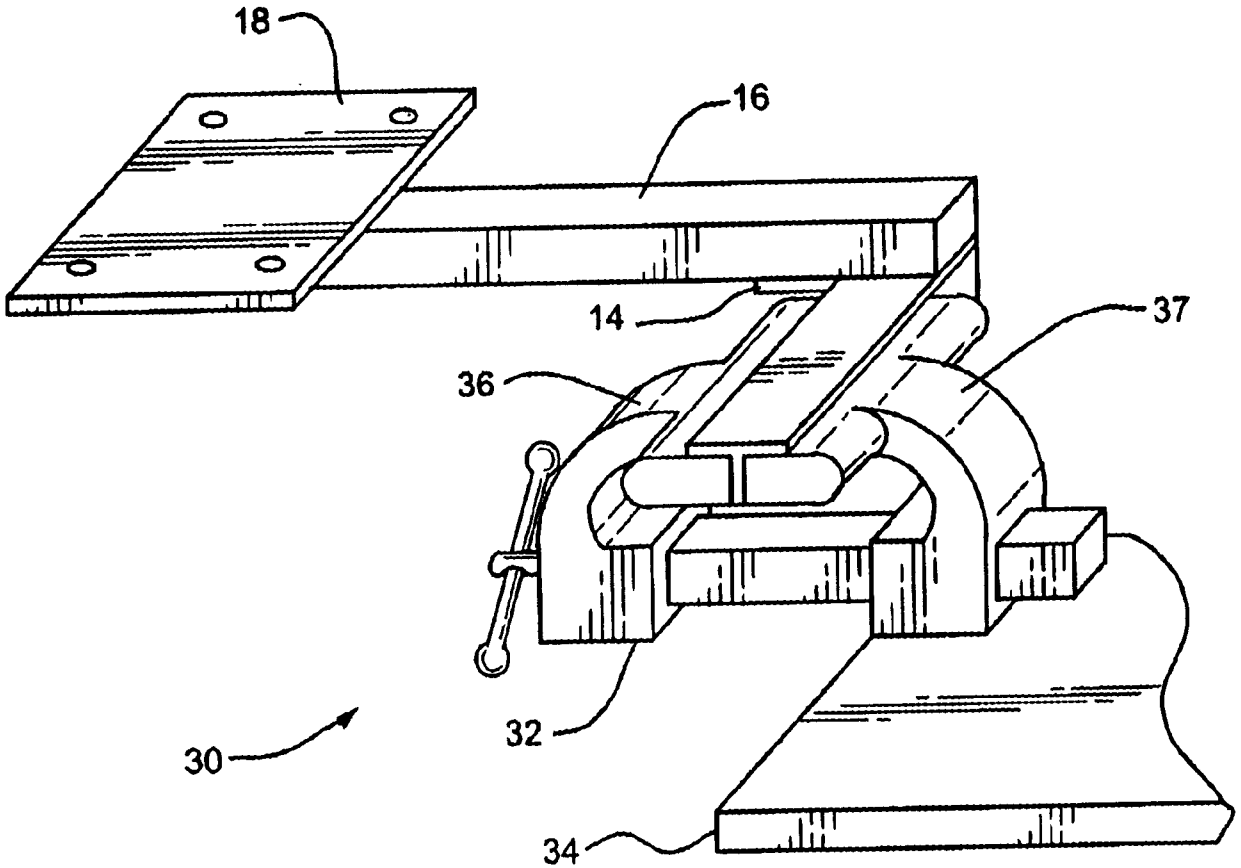
FIG. 3B is an oblique view of the mounting bracket shown in FIG. 2B in place in a vise, according to the principles of the present invention.

Referring to FIGS. 1 and 2, and exemplary mounting bracket according to the principles of the present invention is shown in a top oblique view 10. The mounting bracket is preferably made of metal, such as steel or aluminum, but may be made from any suitable material having the strength to perform its functions. The stand has two angular pieces 12 and 14 which intersect at right angles, each having a horizontal top surface and vertical surface beneath. The two angular pieces 12, 14 may have an "L" shaped cross section as shown in FIGS. 1A, 2A, and 3A or a "T" shaped cross section as shown in FIGS. 1B, 2B, 3B, and 6, though the "T"" shaped cross section may be somewhat more difficult to attach.

In use, it is advantageous to hold the mounting bracket by putting the vertical surface of angle piece 12 between the jaws of a vise, and butting the vertical surface of angle piece 14 against the edge of the jaws of the vise.

Figure 7:
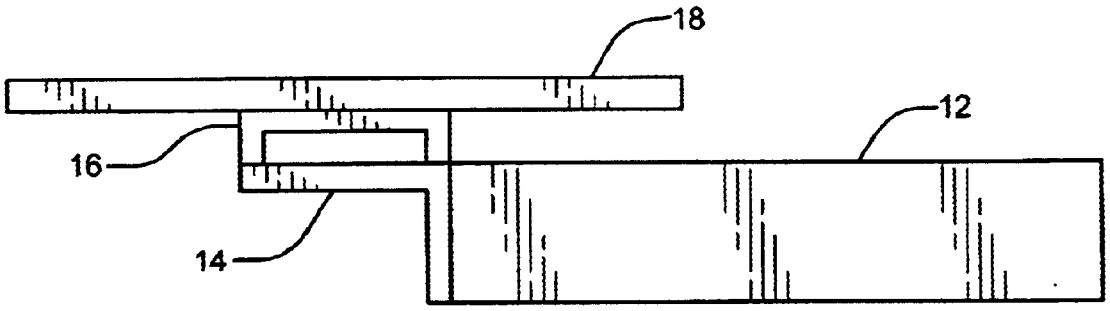
FIG. 7 is an end view of yet another embodiment of the mounting bracket according to the present invention.

At right angles to the first angular piece 12 and attached to the upper surface of the second angular piece 14 is a support member 16 extending beyond the end of the second angular piece 14 a distance. The support member 16 may have a rectangular cross section, but may beneficially have an "I" shaped cross section, an "L" shaped cross section, or a "U" shaped cross section, FIG. 7. When the support member 16 includes an "I", "L", or "U" shaped cross sectional, it may be attached to the vertical side of the second angle pieces 14 rather than the top.

At or near the opposite end of the support member 16 from the angular pieces 12 and 14 is a support plate. This is typically of a size so as to be able to receive thereon a variety of different bicycle stands intended to be bolted onto a bench. In the example shown, the support plate has a square array of holes 20 which have been located so as to receive the base of a bicycle mount (not shown) having a corresponding hole pattern.

Referring to FIG. 3, a mounting bracket according to the principles of the present invention is shown 20 held in a vise 32. (For ease of visualization, the vertical edge of angle piece 14 is shown away from the edge of the jaws 37 and 36 of the vise 32. Typically, this surface would be held butted against the sides of the jaws 36 and 37.)The vise is shown permanently mounted to a work surface 34. The support member is of a length so as to position the support plate sufficiently far away from the edge of the work surface 34 as to allow clearance to hold a bicycle stand and bicycle (not shown) so that they both are clear of the edge of the work surface.

Figure 4:
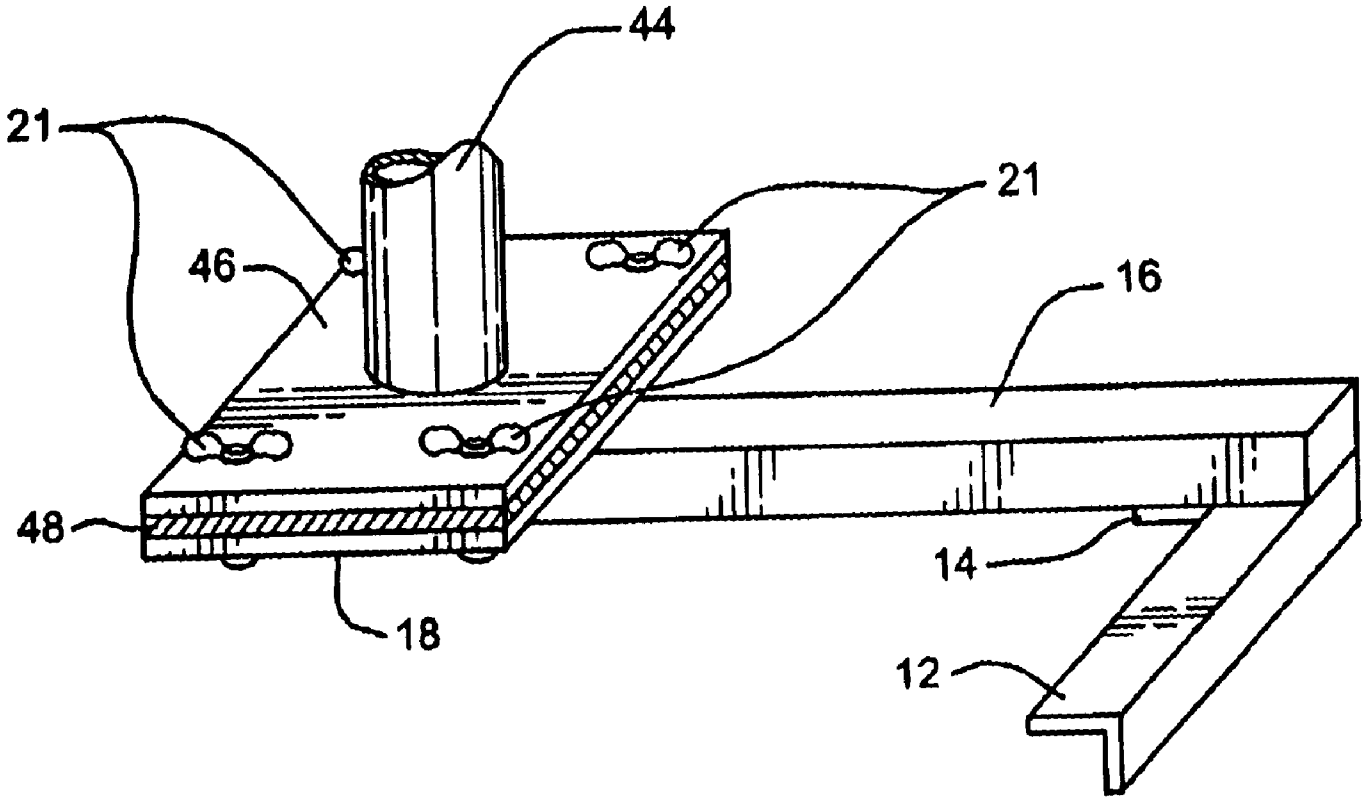
FIG. 4 is a view of a mounting bracket showing a portion of a bicycle clamp mounted to the stand.

FIG. 4 shows a portion of a bicycle stand 44 having a base 46 attached to the mounting plate 18. The stand is held to the mounting plate by bolts and wing nuts 21. Other fasteners may be used, and may be oriented differently than as shown.

Figure 5:
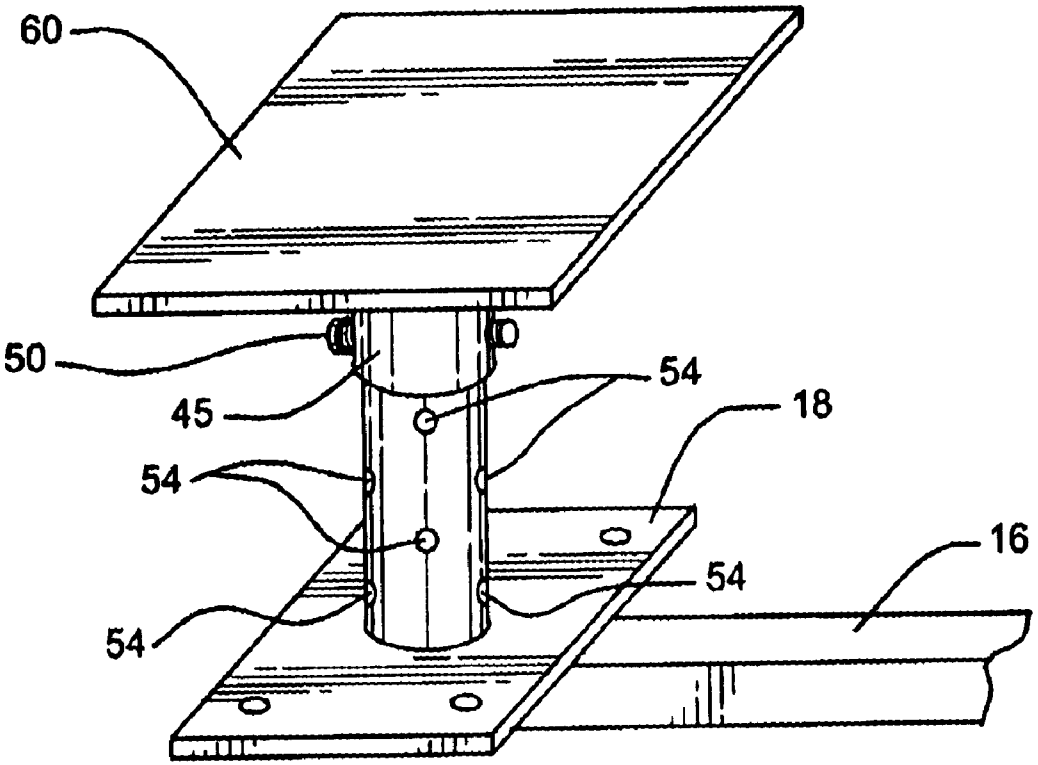
FIG. 5 is a partial view of a mounting bracket with interchangeable tools.
Figure 6:
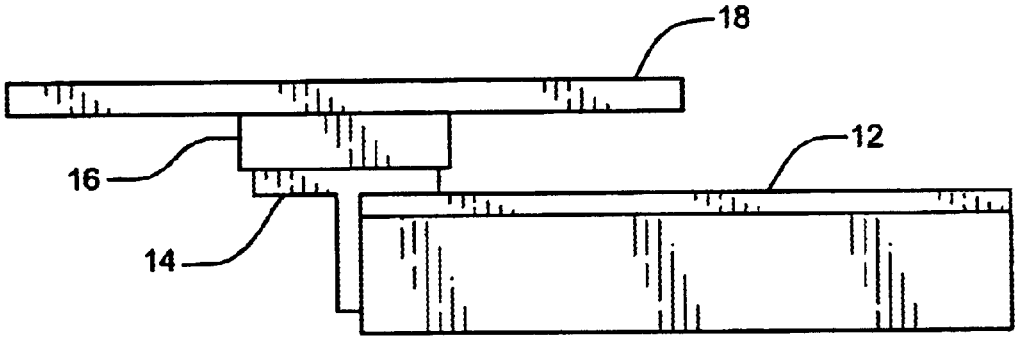
FIG. 6 is an end view of another embodiment of the mounting bracket according to the present invention.

In anther embodiment, shown in FIG. 5, the mounting bracket has a plate 18 to which is permanently attached a vertical post 43. While the post is shown having a circular cross section, other shapes may be used beneficially such as square or octagonal. The post is provided with holes 54 through which a clevis pin 50 may be inserted so as to hold a mating receiver 45 in place.

FIG. 5 further shows an implementation of a mating receiver assembly 45. The mating receiver allows for vertical height adjustment of a second mounting plate 60 attached to the mating receiver 45, and any device mounted thereon. It also permits rotation of the second mounting plate 60, depending upon the shape of the post 44. A circular post 44 and receiver has the greatest degree of freedom of rotation, while an octagonal post has provides greater stability against undesired rotation but fewer positions. The second mounting plate 60 is used in the same manner as described above for the first mounting plate, having the added feature of vertical and rotational adjustment. Moreover, a variety of different tools may be mounted on separate receiver assemblies 45 to be easily taken on and off the bracket as needed.

Modifications and substitutions by one of ordinary skill in the art are considered to be within the scope of the present invention, which is not to be limited except by the following claims.

The invention claimed is:

1. A vice-mountable tool bracket comprising:

a first support section, wherein a portion of said first support is adapted to be able to be held in a vise;

a second support section having a first end disposed at an angle greater than zero with respect to said first support section;

a third support section having a first and a second end, said third support disposed substantially parallel with said second support section; and a plate disposed proximate said second end of said third support section wherein said plate is wider than a width of said third support section.

2. The vice-mountable tool bracket of claim 1 wherein said first, said second, and said third support sections are made of metal.

3. The vice-mountable tool bracket of claim 2 wherein the metal is steel.

4. The vice-mountable tool bracket of claim 2 wherein the metal is aluminum.

5. The vice-mountable tool bracket of claim 1 wherein said first and said second support sections are disposed at substantially a 90 degree angle with respect to each other.

6. The vice-mountable tool bracket of claim 1 wherein at least one of the first section and the second section have an "L" shaped cross section.

7. The vice-mountable tool bracket of claim 1 wherein at least one of the first section and the second section have a "T" shaped cross section.

8. The vice-mountable tool bracket of claim 1 wherein said third support section has a rectangular cross section.

9. The vice-mountable tool bracket of claim 1 wherein said first support section includes a vertical surface that is adapted to be able to be held in a vice.

10. The vice-mountable tool bracket of claim 1 wherein said third support section has a "U" shaped cross section.

11. The vice-mountable tool bracket of claim 1 wherein said plate has holes adapted to receive mounting fasteners for a bicycle holder.

12. The vice mountable tool bracket of claim 1 further comprising a first post attached to an upper surface of said plate, said first post adapted to receive and hold a second mating post, and wherein one end of said second mating post is attached to a lower surface of a second plate.

13. The vise mountable tool bracket of claim 12 wherein the first post further comprises a plurality of holes, and the second mating post has at least one hole located so as to overlie at least one of the plurality of holes when mated to the first post; and further comprising a pin insertable into the at least one mating hole and a selectable one of the plurality of holes in the first post.

* * * * *